US005596846A

United States Patent [19]

Kelly

[11] Patent Number: 5,596,846

[45] Date of Patent: Jan. 28, 1997

[54] LIFTING ANCHOR FOR EMBEDMENT IN CONCRETE MEMBERS

[75] Inventor: David L. Kelly, Sacramento, Calif.

[73] Assignee: The Burke Group, Sacramento, Calif.

[21] Appl. No.: 542,727

[22] Filed: Oct. 13, 1995

[51] Int. Cl.[6] ..... E04G 21/16; E04H 12/34

[52] U.S. Cl. ..... 52/125.2; 52/125.3; 52/125.4; 52/698; 52/712; 52/714; 52/715

[58] Field of Search ..... 52/125.4, 125.2, 52/699, 712, 714, 715, 125.3, 698; 248/499; 294/89

[56] References Cited

U.S. PATENT DOCUMENTS

| | | | |
|---|---|---|---|
| 2,886,370 | 5/1959 | Liebert | 294/89 |
| 3,652,118 | 3/1972 | Goldberg | 294/89 |
| 3,883,170 | 5/1975 | Fricker et al. . | |
| 4,173,856 | 11/1979 | Fricker . | |
| 4,296,909 | 10/1981 | Haeussler | 294/89 X |
| 4,367,892 | 1/1983 | Holt . | |
| 4,580,378 | 4/1986 | Kelly et al. . | |
| 4,702,045 | 10/1987 | Fricker | 52/125.4 |
| 4,930,269 | 6/1990 | Kelly et al. . | |

FOREIGN PATENT DOCUMENTS

| | | |
|---|---|---|
| 568934 | 4/1993 | European Pat. Off. . |

*Primary Examiner*—Christopher T. Kent
*Attorney, Agent, or Firm*—Limbach & Limbach L.L.P.

[57] ABSTRACT

An improved anchor for embedment in a concrete member to provide a lifting attachment for the member. The anchor comprises an elongate bar having convergent and divergent surfaces wherein the divergent surfaces face outwardly to direct axial pull-out forces imparted to the bar divergently and laterally into a concrete member within which the anchor is embedded. Divergent wings are fixed to and extend laterally from the bar to direct lateral forces imparted to the bar in divergent directions relative to the bar.

23 Claims, 2 Drawing Sheets

LIFTING ANCHOR FOR EMBEDMENT IN CONCRETE MEMBERS

BACKGROUND OF THE INVENTION

The present invention relates to an improved lifting anchor for embedment in concrete member, such as a precast or tilt-up wall. In its more specific aspects, the invention is directed to such an anchor which comprises an elongate bar having divergent surfaces which face outwardly to direct axial pull-out forces imparted to the bar divergently and laterally into a concrete member within which the anchor is embedded. The invention is also concerned with such an anchor wherein divergent wings extend laterally from the bar to direct lateral forces imparted to the anchor in divergent directions relative to the bar.

The prior art relative to the present invention is typified by U.S. Pat. Nos. 3,883,170 and 4,173,856. These patents each relate to lifting anchors for embedment in concrete members and a quick release hoisting shackle or coupling engageable with these anchors. The anchors in the '170 patent take the form of bars having split divergent ends or ends turned upon themselves to resist pull-out. The anchors of the '856 patent also employ bars having split divergent ends to resist pull-out. The later patent is especially directed to an improved construction for the top of the anchor to avoid spalling or break-out of the surface of the concrete member by a coupling engaged with the member.

U.S. Pat. Nos. 4,367,892; 4,580,378 and 4,930,269 are also of interest in that they disclose anchors for use with lifting shackles or couplings of the type with which the anchor of the present invention is intended to be used. The anchors of the '892 patent are of a T-shaped configuration to resist pull-out and are generally formed by casting. The anchors of the '378 patent are stamped and embody a pin which extends transversely through the anchor to resist pull-out. The anchors of the '269 patent are formed of heavy wire stock which is bent into an inverted V-shaped configuration and has integrally formed laterally extending distal ends which are formed by bending and provide resistance to pull-out.

The anchor of the present invention is fabricated of flat steel stock corresponding generally to that of the anchors in the '170 and '856 patents and is adapted to be engaged by a lifting coupling or shackle of the type shown in these patents.

SUMMARY OF THE INVENTION

In its broadest aspects, the anchor of the present invention comprises an elongate bar having convergent and divergent surfaces wherein the divergent surfaces face outwardly to direct axial pull-out forces imparted to the bar divergently and laterally into a concrete member within which the anchor is embedded. The convergent and divergent surfaces are formed in the sides of the bar without the necessity of splitting the bar or turning up its ends. The divergent surfaces terminate in an enlarged foot formed at the proximal end of the bar.

In the preferred embodiment, divergent wings extend laterally from an edge of the bar to transmit lateral lifting forces to a concrete member within which the bar is embedded in outwardly divergent directions.

A principal object of the invention is to provide a lifting anchor for embedment in a concrete member which resists axial (tension) pull-out, without the necessity of relying upon a split or bent up end, or a separate pin extending through the anchor.

Another and more specific object of the invention is to provide such an anchor which develops its pull-out resistance by tapering of the body of the anchor first in a convergent direction and then in a divergent direction.

Still another object of the invention is to provide such an anchor which may be formed from flat steel stock by a simple stamping operation, without the necessity of spitting and/or bending.

A further object of the invention is to provide such an anchor with laterally extending divergent wings which function to transmit lateral forces imparted to the anchor outwardly in divergent directions.

Still another object of the invention is to provide such an anchor which may be used with known hoisting shackles or couplings and provides means whereby lateral forces imparted to the anchor are resisted to avoid breaking away or spalling of the surface of the concrete member within which the anchor is embedded.

Yet another and related object of the invention is to provide such an anchor which has means to accommodate reinforcements for the concrete member within which it is embedded.

These and other objects will become more apparent when viewed in light of the accompanying drawings and following detailed description.

DESCRIPTION OF THE PREFERRED EMBODIMENT

Figure 1:
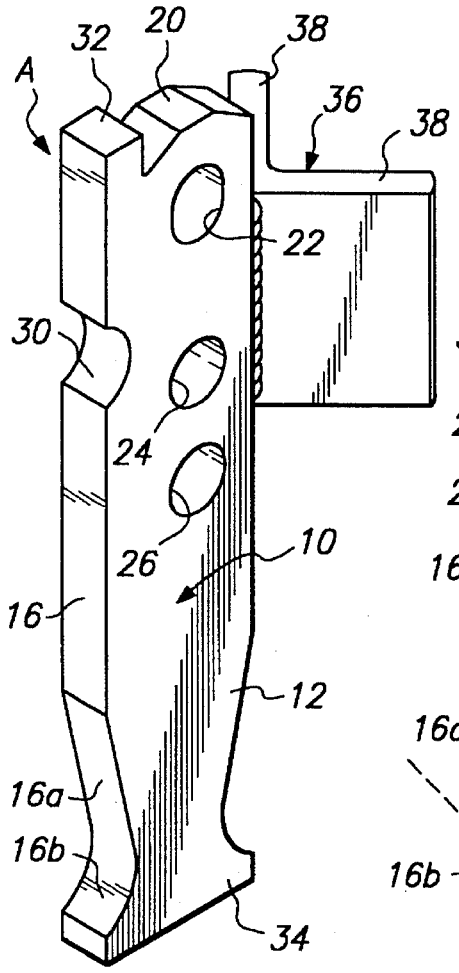
FIG. 1 is a perspective view of an anchor formed according to the present invention.

Referring to the drawings, the inventive anchor is designated therein in its entirety by the letter "A" (see FIG. 1). The anchor comprises an elongate bar 10, preferably die-cut from steel stock of a thickness "t" (see FIG. 3). The exact dimensions of the anchor are dependent upon the desired load capacity. A four ton anchor would typically be fabricated of ⅝ inch steel stock and have an overall length of 9½ inches and a width, as viewed in FIG. 2, of approximately 2 inches. The opposite sides of the plate are designated by the numerals 12 and 14 and the side edges are designated 16 and 18.

The bar is formed with an upper or distal end 20 which provides a bridge over an opening 22 for the locking bolt of a shackle used with the anchor. The opening 22 extends through the opposite sides 12 and 14 of the bar 10. Openings 24 and 26 also extend transversely through the bar and the opposite sides thereof for the receipt of tension bars or rebars. The openings 22, 24 and 26 are aligned along a longitudinal lifting axis, designated 28. Rebar is also accommodated by an arcuate cut-out 30 formed in the side edge 16. The distal end 20 is formed with an extension 32 to one side thereof for engagement with a shackle coupled to the anchor (see FIG. 5).

Figure 2:
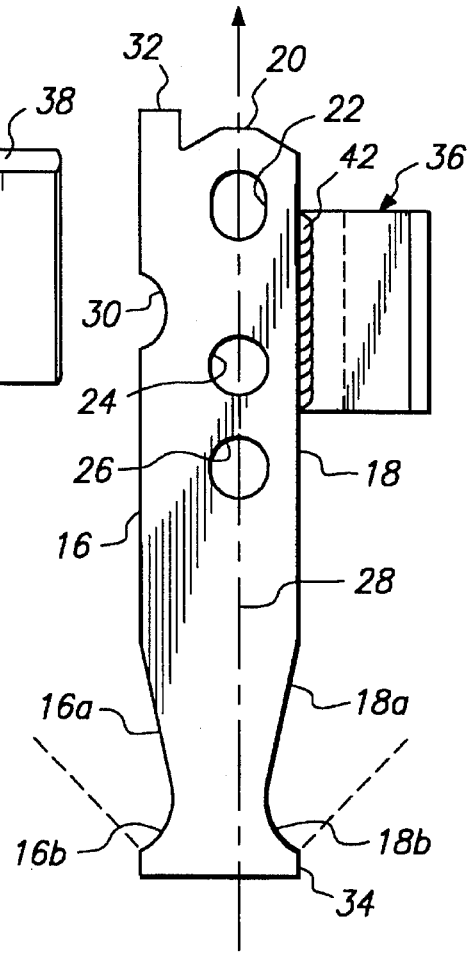
FIG. 2 is a side elevational view of the anchor, with an arrow line depicting axial lifting force applied to the anchor and dashed lines depicting the approximate boundary of the volume to which lateral force is applied to a concrete member within which the anchor is embedded in response to such axial lifting force.
Figure 3:
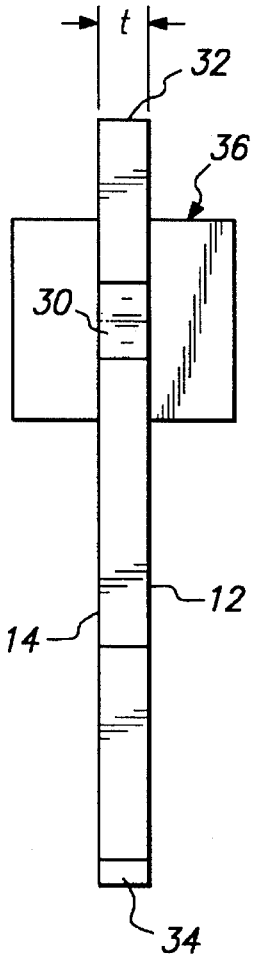
FIG. 3 is an edge elevational view of the anchor.

The proximal portion of the bar 10 terminates in an enlarged foot 34 having a depth sufficient to avoid distortion when axial lifting forces are applied to the anchor (e.g., ⅜ inch for a four ton anchor dimensioned as above). As viewed in FIG. 2, the bar is formed with a convergent section defined by side edges 16*a* and 18*a* and a divergent section defined by side edges 16*b* and 18*b*. The divergent section merges the convergent section with the enlarged foot 34. For a four ton anchor dimensioned as above, the convergent section would extend at an angle of approximately 10° relative to the longitudinal axis 28 and the divergent section would have a radius of approximately ¾ inch. Surfaces 16*b* and 18*b* of the divergent section provide for the transmission of pull-out forces laterally of the bar in divergent directions when the anchor is embedded in a concrete slab and an axial lifting force is applied thereto. Axial lifting force is depicted by the arrow line at the top of FIG. 2. The dashed lines radiating from the bottom of FIG. 2 depict the approximate boundary of the volume of concrete to which lateral force is applied by the surfaces 16*b* and 18*b* when axial lifting force is applied to the anchor. This boundary is actually conical and extends at an angle of approximately 45° relative to the longitudinal lifting axis 28. If the shear strength of the concrete were exceeded, the concrete would shear generally along the conical surface represented by the these lines. Radiating the forces divergently increases the volume of concrete which resists such shearing.

Figure 4:
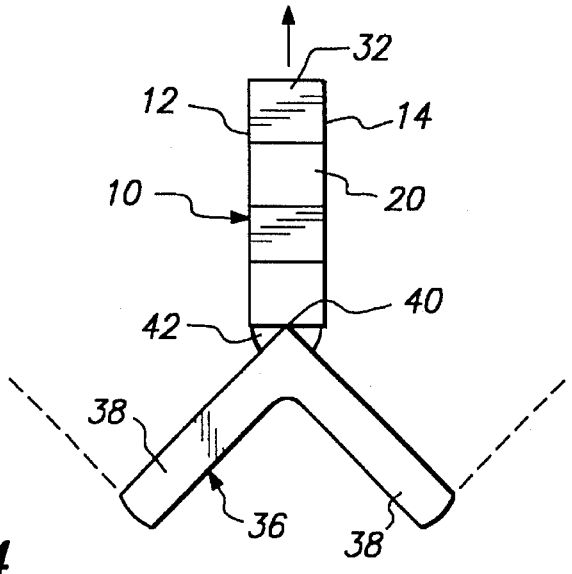
FIG. 4 is a top plan view of the anchor, with an arrow line depicting lateral lifting force applied to the anchor and dashed lines depicting the approximate boundary of the volume to which force is applied to a concrete member within which the anchor is embedded in response to such lateral lifting force.

An angle member 36 having wings 38 disposed at an angle of approximately 90° relative to one another is welded to and forms a part of the anchor "A". The wings 38 meet at bend line or apex 40 which is welded to the edge 18 by a weld bead 42 so as to extend longitudinally and symmetrically relative to the bar 10. As can be seen from FIG. 4, the wings extend at an angle of approximately 45° relative to the flat sides 12 and 14 of the bar 10. The arrow line to the top of FIG. 4 depicts lateral lifting force applied to the anchor and the dashed lines in FIG. 4 depict the approximate boundary of the volume of concrete to which lateral force is applied in response to such lateral force. The forces are so imparted to the concrete by the angle member 36 extend at approximately 45° relative to the direction of lateral lifting force depicted in FIG. 4.

Figure 5:
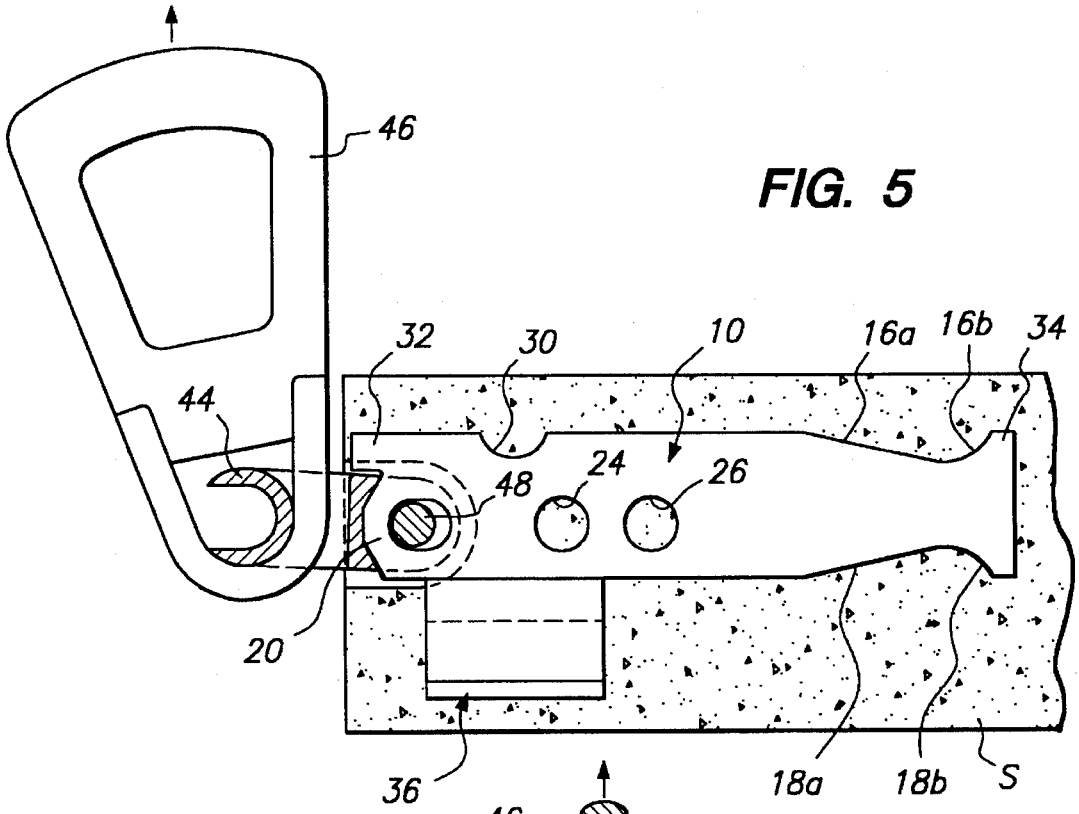
FIG. 5 is a side elevational view showing the anchor embedded in a concrete slab and a hoisting shackle connected to the anchor to impart lateral lifting force thereto to tilt the slab upwardly; and, FIG. 6 is an edge elevational view showing the anchor embedded in a concrete slab and a hoisting shackle connected to the anchor to impart axial force thereto to lift the slab.

A shown in FIG. 5, the anchor is embedded in the edge of a concrete slab "S" and a hoisting shackle 44, 46 is releasably attached to the distal end 20 of the anchor by the locking bolt 48 of the shackle. The hoisting shackle 44, 46 is of the type taught by U.S. Pat. No. 3,883,170. FIG. 5 shows the preferred orientation of the anchor within a slab "S" cast in a horizontal position. In this orientation, the angle member 36 is at the bottom of the anchor and the extension 32 is at the top of the anchor. As so disposed, the lower inside surface of the extension 32 is disposed for engagement with the portion 44 of the shackle when lifting force is applied, as depicted by the arrow line at the top of shackle portion 46. Such interengagement between the shackle portion 44 and the extension 32 shields the surface of the slab from engagement by the shackle and avoids the breakaway of the concrete which could result from such engagement.

The lifting force depicted by the arrow line in FIG. 5 corresponds to that which would be used when tilting a horizontally cast slab to an upright position. This is the same force depicted by the arrow line at the left of FIG. 4. Accordingly, it should be appreciated that the angle member 36 depicted in FIG. 5 would transmit lifting force to the slab "S" within the approximate boundaries depicted by the dashed lines of FIG. 4.

Figure 6:
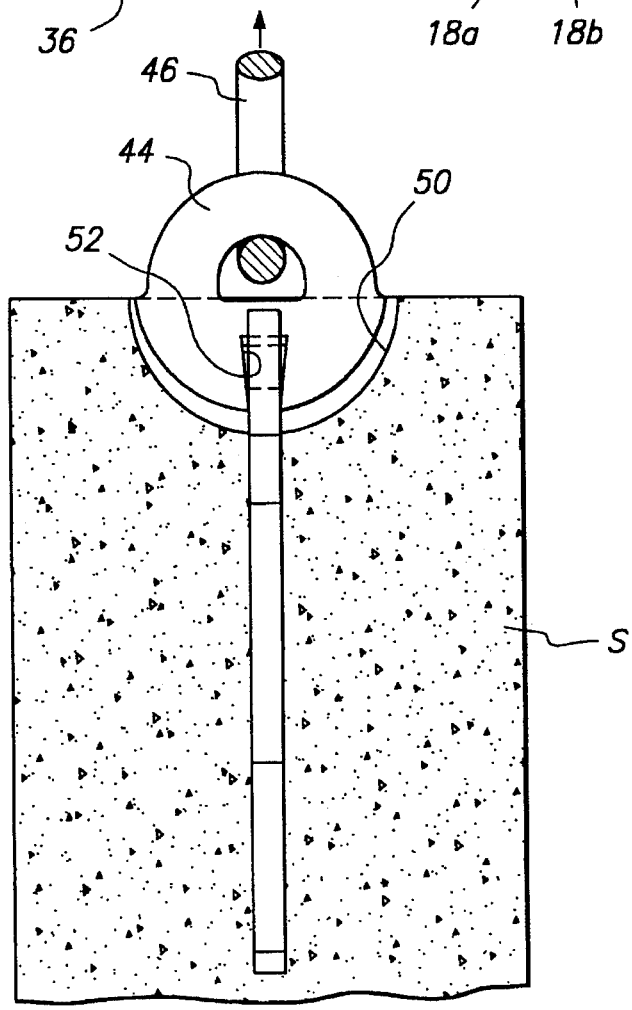

FIG. 6 shows the anchor embedded in the concrete slab "S", viewed 90° from the illustration in FIG. 5. As shown in FIG. 6, the arrow line at the top depicts axial lifting force being applied to the anchor. FIG. 6 also shows the void 50 formed in the edge of the slab to expose the distal end of the anchor and the slot 52 of the shackle part 44 which engages around the distal end of the anchor bar 10. It should be appreciated that the forces imparted to the slab "S" by the axial lifting force depicted in FIG. 6 would be dissipated through the slab within the approximate boundary depicted by the dashed lines in FIG. 2. The lifting force depicted by the arrow lines in FIGS. 2 and 6 correspond.

CONCLUSION

With the foregoing description, it is believed apparent that the present invention enables the attainment of the objects initially set forth herein. In particular, it provides a lifting anchor fabricated of metallic plate which provides divergent surfaces to transmit pull-out forces divergently and laterally without the necessity of forming splits or bends in the plate. In the preferred embodiment, the anchor also provides divergent lateral surfaces which transmit forces divergently during lateral lifting for tilt-up. It should be understood, however, that the invention is not intended to be limited to the specifics of the illustrated embodiment, but rather is defined by the accompanying claims.

What is claimed is:

1. An anchor for embedment in a concrete slab to provide for the lifting of the slab, said anchor comprising:

a. an elongate metallic bar having distal and proximal ends;

b. a lifting connection on the bar adjacent the distal end thereof for engagement by a lifting coupling;

c. an enlarged foot formed on the proximal end of the bar for embedment in the slab;

d. a convergent section formed on the bar between the proximal and distal ends, said convergent section having surfaces converging toward said enlarged foot;

e. a divergent section formed on the bar between the convergent section and the distal end to merge the convergent section with the enlarged foot and provide divergent surfaces which transmit pull-out forces divergently and laterally of the bar when the anchor is embedded in a concrete slab and, f. a pair of divergent wings fixed to and extending laterally from the bar for embedment in a concrete slab to transmit lateral lifting forces to the slab in outwardly divergent directions.

2. An anchor according to claim 1 wherein the bar has a longitudinal axis and said divergent surfaces are positioned to transmit longitudinal pull-out forces applied to the bar divergently and laterally into a concrete slab within which the anchor is embedded through a volume extending at an angle of approximately forty five degrees relative to said longitudinal axis.

3. An anchor according to claim 1 wherein:

a. the bar is formed with spaced oppositely disposed generally parallel flat sides bounded by edge surfaces extending therebetween; and, b. the convergent and divergent surfaces are formed by said edge surfaces.

4. An anchor according to claim 3 wherein the divergent surfaces are curvilinear and merge smoothly with the convergent surfaces.

5. An anchor according to claim 3 wherein the bar is formed of flat steel stock.

6. An anchor according to claim 3 wherein the lifting connection comprises an aperture extending across the bar and through the oppositely disposed generally parallel flat sides.

7. An anchor according to claim 1 wherein:

a. the bar is formed with spaced oppositely disposed generally parallel flat sides bounded by edge surfaces extending therebetween; and, b. the divergent wings are fixed to and extend from an edge surface disposed between said oppositely disposed generally parallel flat sides.

8. An anchor according to claim 7 wherein the divergent wings each extend at an angle of approximately forty five degrees relative to the flat sides of the bar.

9. In combination with a cast concrete member having an exterior surface, an improved anchor to provide for lifting of the member, said anchor comprising:

a. an elongate metallic bar embedded within the member, said bar having a distal portion exposed externally of the member and a proximal portion captured within the member;

b. a lifting connection on the distal portion of the bar for engagement by a lifting coupling;

c. an enlarged foot formed on the proximal portion of the bar;

d. a convergent section formed on the bar between the proximal and distal portions, said convergent section having surfaces converging toward said enlarged foot;

e. a divergent section formed on the bar between the convergent section and the foot to merge the convergent section with the foot and provide divergent surfaces which transmit pull-out forces divergently and laterally of the bar into the concrete member and, f. a pair of divergent wings fixed to and extending laterally from the bar to transmit lateral lifting forces to the concrete member in outwardly divergent directions.

10. In a combination according to claim 9, the improved anchor wherein the bar has a longitudinal axis and said divergent surfaces are positioned to transmit longitudinal pull-out forces applied to the bar divergently and laterally into the concrete member through a volume extending at an angle of approximately forty five degrees relative to said longitudinal axis.

11. In combination according to claim 9 the improved anchor wherein:

a. the bar is formed with spaced oppositely disposed generally parallel flat sides bounded by edge surfaces extending therebetween; and, b. the convergent and divergent surfaces are formed by said edge surfaces.

12. In a combination according to claim 11, the improved anchor wherein the divergent surfaces are curvilinear and merge smoothly with the convergent surfaces.

13. In a combination according to claim 11, the improved anchor wherein the bar is formed of flat steel stock.

14. In a combination according to claim 11, the improved anchor wherein the lifting connection comprises an aperture extending across the bar and through the oppositely disposed generally parallel flat sides.

15. In a combination according to claim 9, the improved anchor wherein:

a. the bar is formed with spaced oppositely disposed generally parallel flat sides bounded by edge surfaces extending therebetween; and, b. the divergent wings are fixed to and extend from an edge surface disposed between said oppositely disposed generally parallel flat sides.

16. In a combination according to claim 15, the improved anchor wherein the divergent wings each extend at an angle of approximately forty five degrees relative to the flat sides of the bar.

17. An improved anchor for embedment in a concrete member to provide a lifting attachment for the member, said anchor comprising: an elongate axially extending bar having convergent and divergent surfaces wherein the divergent surfaces face outwardly to direct axial pull-out forces imparted to the bar divergently and laterally into a concrete member within which the anchor is embedded; and, divergent wings fixed to and extending laterally from an axially extending surface of the bar to direct lateral forces imparted to the bar in divergent directions relative to the bar.

18. An anchor according to claim 17 wherein the bar has a longitudinal axis and said divergent surfaces are positioned to transmit longitudinal pull-out forces applied to the bar divergently and laterally into a concrete slab within which the anchor is embedded through a volume extending at an angle of approximately forty five degrees relative to said longitudinal axis.

19. An anchor according to claim 17 wherein:

a. the bar is formed with spaced oppositely disposed generally parallel flat sides bounded by edge surfaces extending therebetween; and, b. the convergent and divergent surfaces are formed by said edge surfaces.

20. An anchor according to claim 19 wherein the divergent surfaces are curvilinear and merge smoothly with the convergent surfaces.

21. An anchor according to claim 19 wherein the bar is formed of flat steel stock.

22. An anchor according to claim 17 wherein:

a. the bar is formed with spaced oppositely disposed generally parallel flat sides bounded by edge surfaces extending therebetween; and, b. the divergent wings are fixed to and extend from an edge surface disposed between said oppositely disposed generally parallel flat sides.

23. An anchor according to claim 22 wherein the divergent wings each extend at an angle of approximately forty five degrees relative to the flat sides of the bar.

* * * * *